US006771179B1

(12) United States Patent
Post et al.

(10) Patent No.: US 6,771,179 B1
(45) Date of Patent: Aug. 3, 2004

(54) SECURITY MODULE WITH STATUS SIGNALING

(75) Inventors: Peter Post, Berlin (DE); Dirk Rosenau, Berlin (DE); Torsten Schlaaff, Zepernick (DE); Andreas Wagner, Berlin (DE)

(73) Assignee: Francotyp-Postalia AG & Co. KG, Birkenwerder (DE)

( * ) Notice: Subject to any disclaimer, the term of this patent is extended or adjusted under 35 U.S.C. 154(b) by 0 days.

(21) Appl. No.: 09/524,118

(22) Filed: Mar. 13, 2000

(51) Int. Cl.[7] ..... G08B 21/00
(52) U.S. Cl. ..... 340/653; 340/693.5
(58) Field of Search ..... 340/653, 693.5, 340/635, 658, 571, 691.1, 636; 380/2, 52

(56) References Cited

U.S. PATENT DOCUMENTS

| | | | | |
|---|---|---|---|---|
| 4,575,621 A | | 3/1986 | Dreifus | |
| 5,097,253 A | | 3/1992 | Eschbach et al. | |
| 5,353,350 A | * | 10/1994 | Unsworth et al. | 380/3 |
| 5,515,540 A | | 5/1996 | Grider et al. | |

FOREIGN PATENT DOCUMENTS

| | | | |
|---|---|---|---|
| EP | 0 417 447 | | 3/1991 |
| EP | 0 789 333 | | 8/1997 |
| GB | 2302173 A | * | 12/1997 |
| GB | 2 303 173 | | 12/1997 |
| WO | WO 98/20461 | | 5/1998 |

OTHER PUBLICATIONS

"Information Based Indicia Program Postal Security Device Specification", United States Postal Service, Jun. 13, 1996.

* cited by examiner

*Primary Examiner*—Julie Lieu
(74) *Attorney, Agent, or Firm*—Schiff Hardin LLP

(57) ABSTRACT

A security module with status signaling, has a battery, and function units that are interconnected with one another and are covered by a casting compound. The battery is replaceably arranged on the security module, with the casting compound surrounding a first part of the printed circuit board, and a second part of the printed circuit board for the replaceably arranged battery being free of casting compound. For signaling the module status, an optical or acoustic signal element is connected to the printed circuit board.

4 Claims, 5 Drawing Sheets

SECURITY MODULE WITH STATUS SIGNALING

BACKGROUND OF THE INVENTION

1. Field of the Invention

The present invention is directed to a security module which allows signaling of a status of the security module particularly a postal security module suitable for use in a postage meter machine or mail processing machine or a computer with mail-processing function.

2. Description of the Prior Art

Modern franking machines or other devices for franking postal matter are equipped with a printer for printing a postage value stamp (imprint) on a postal item, with a control unit for controlling the printing and the peripheral components of the postage meter machine, an accounting unit for debiting postage fees that are maintained in non-volatile memories, and a unit for encrypting postage fee data. The accounting unit and/or the encrypting unit can be realized in a component known as a security module (European Application 789 333).

The processor of the security module is, for example, an OTP (one-time programmable) processor that stores sensitive data such as cryptographic keys in a manner that is protected against readout. Encapsulation by a security housing offers further protection.

Security modules are likewise known from other electronic data processing systems and are equipped with means for protection against break-in into their electronics (European Patent 417 447).

Further measures for protecting a security module against tampering with the data stored therein are described in German Applications 198 16 572.2 and 198 16 571.4. Power consumption is increased in these devices due to the use of a number of sensors, and a security module that is not constantly supplied by a system voltage then draws the current required for the sensors from its internal battery, which prematurely drains the battery. The capacity of the battery and the power consumption thus limit the service life of such a security module.

Security modules for postage meter machines can be realized as multi-chip modules or as single-chip systems (for example, chip cards). Structurally, they are either rigidly connected to the postage meter machine or are pluggable. A pluggable security module that can assume various statuses in its life cycle. One must thereby detect whether the security module contains valid cryptographic keys. Further, it is also important to distinguish whether the security module is functioning or is defective. It is disadvantageous if a suitable "status reading device", for example a postage meter machine or some other device, must be present for this purpose. Under certain circumstances, such a device can be tampered with to generate a manipulated, incorrect status signaling. Existing security modules for postage meter machines have their own optical or acoustic signal means. They can only indirectly output their status, for example via beepers or the display elements of a postage meter machine. The status display can be automatically called when starting the system or can be interactively called by the user of the postage meter machine when the security in the signaling of a status can be guaranteed.

SUMMARY OF THE INVENTION

An object of the present invention is to provide a pluggable security module which has a long service life and which and dependably signals the module status.

The above object is achieved in accordance with the present invention in a security module having functional units which are interconnected with each other and which are covered by a casting compound, with the casting compound surrounding at least a part of the printed circuit board to which the functional units are connected, and wherein an optical or an acoustical signal element is connected to one of the functional units for signaling a status of the security module.

The circuit with the processor of the security module that contains sensitive data protected against readout and further functional units are protected only by a casting compound. The motherboard of a meter or of a comparable control means is therefore surrounded with a security housing that may be additionally sealed. The security module is potted with a hard compound. For changing batteries and for allowing disposal of the security module in an environmentally safe manner, the battery is arranged outside the casting compound. The battery can be easily replaced by a service technician given a plugged-in security module that is supplied by a system voltage at the time of service.

It is advantageous in the inventive security module to automatically optically (or acoustically) signals the status when the operating voltage is applied. It is thereby possible and adequate as well for the module to make only a rough distinction of the current status on the basis of its own signal means. The exact type and number of module statuses is dependent on the functions realized in the module and on the implementation.

The security module for a postage meter machine assumes the function accounting for the postage fees and/or the function of cryptographic protection of the postage fee data. The inventive security module has a separate signal element or a display unit that, with direct drive by the security module, identifies the current condition of the security module, the module condition being modified when the security module is switched into the unplugged condition and/or when the battery voltage drops below a predetermined threshold, in which case the security module may be supplied with system voltage. The signaling of the module status is activated only when the security module is supplied with system voltage. The signal element is mounted in that region of a printed circuit board of the security module where the surrounding security housing has a viewing window or an opening for signaling the module status. The signal element can be a display unit, and can be a light-emitting diode (LED) in the simplest case. It can project through the casting material. Alternatively or additionally, a number of LEDs or multi-colored LEDs or a liquid crystal display (LCD) or similar signal elements can be used, these being arranged at a part of the printed circuit board that is free of casting material.

DESCRIPTION OF THE PREFERRED EMBODIMENTS

Figure 1:
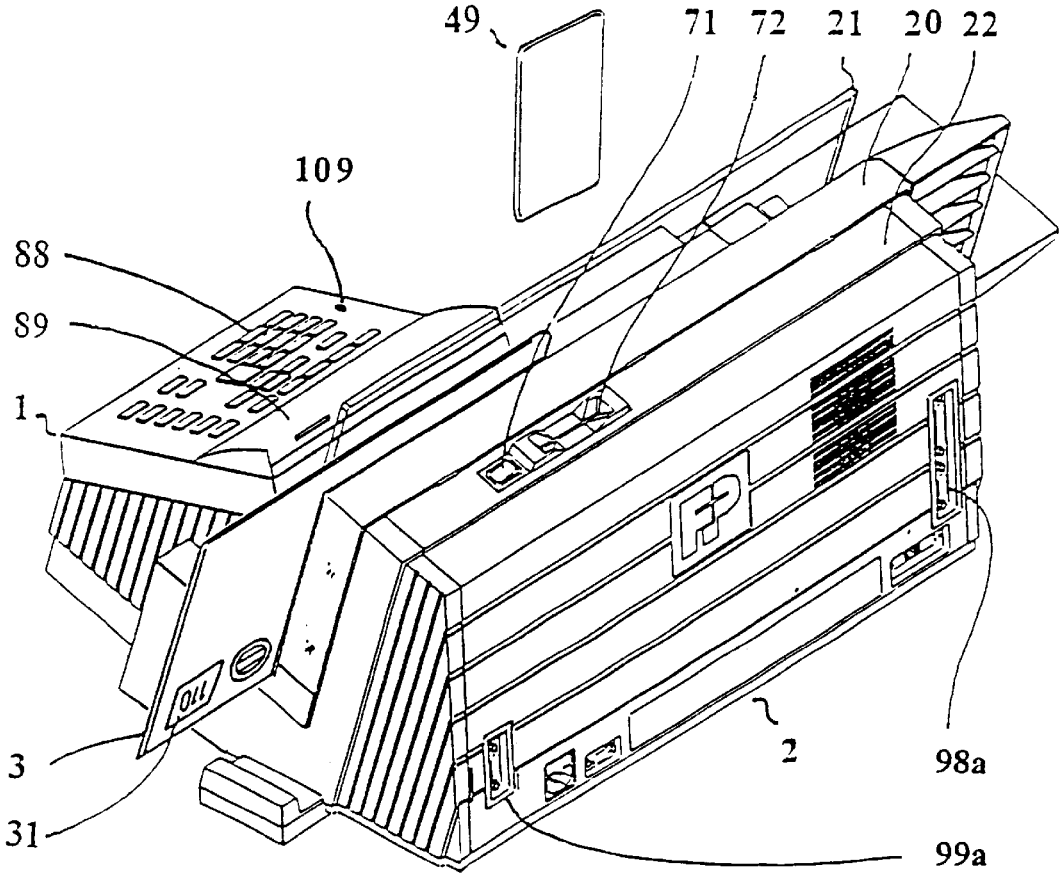
FIG. 1 is a perspective view of a postage meter machine, embodying an inventive security module, from behind.

FIG. 1 shows a perspective view of the postage meter machine from behind. The postage meter machine is composed of a meter 1 and a base 2. The latter is equipped with a chip card write/read unit 70 that is arranged behind the guide plate 20 and is accessible from the upper edge 22 of the housing. After the postage meter machine has been turned on with the switch 71, a chip card 49 is plugged into the plug-in slot 72 from top to bottom. A letter 3 is supplied standing on edge with a surface to be printed lying against the guide plate 20, and is then printed with a franking stamp 31 in conformity with the input data. The letter delivery opening is laterally limited by a transparent plate 21 and by the guide plate 20.

The inventive security module 100 (see FIG. 2) is plugged onto the motherboard of the meter 1 of the postage meter machine or of some other suitable apparatus. It is preferably accommodated within the meter housing, this being fashioned as security housing. The meter housing is designed such that the user can see the status display of the security module from the outside through an opening 109, whereby the opening 109 extends to the operating surfaces 88, 89 of the meter 1.

The display is controlled by the internal processor of the module 100 and thus cannot be manipulated from the outside. The display is constantly active in the operating condition, so that the application of the system voltage $U_{s+}$to the processor of the security module 100 suffices to activate the display in order to be able to read the module status.

Figure 2:
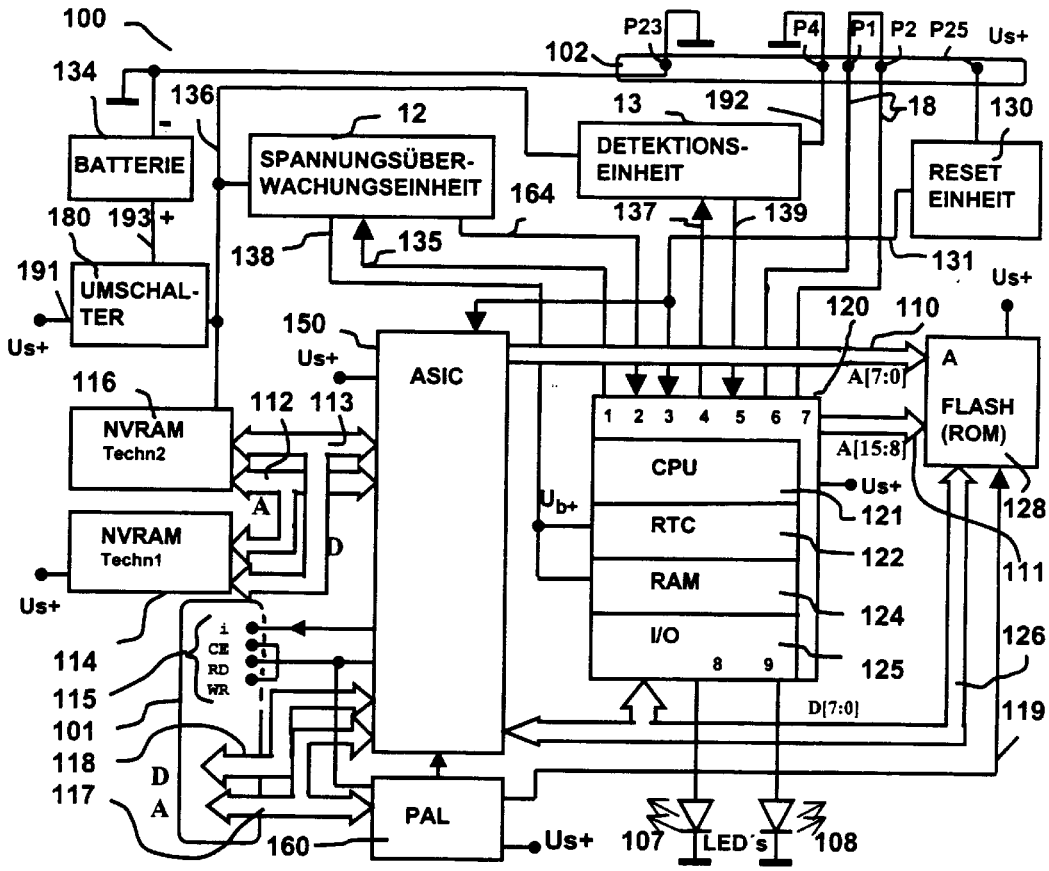
FIG. 2 is a block circuit diagram of an inventive security module.

FIG. 2 shows a block circuit diagram of the postal security module PSM 100 in a preferred version. The negative pole of the battery 134 is at ground and connected to a pin P23 of the contact group 102. The positive pole of the battery 134 is connected via a line 193 to one input of the voltage switchover 180, and the line 191 carrying the system voltage is connected to the other input of the voltage switchover 180. The type SL-389/P is suitable as the battery 134 for a service life of up to 3.5 years, or the type SL-386/P is suitable for a service life of up to six years given maximum power consumption by the PSM 100. A commercially obtainable circuit of the type ADM 8693ARN can be utilized as the voltage switchover 180. The output of the voltage switchover 180 is supplied to the battery monitoring unit 12 and the detection unit 13 via the line 136. The battery monitoring unit 12 and the detection unit 13 are in communication with the pins 1, 2, 4 and 5 of the processor 120 via the lines 135, 164 and 137, 139. The output of the voltage switchover 180 also is connected via the line 136 to the supply input of a first memory SRAM that serves as a non-volatile memory NVRAM in a first technology as a result of the existing battery 134.

The security module is in communication with the postage meter machine via the system bus 115, 117, 118. The processor 120 can enter into a communication connection with a remote data center via the system bus and a modem 83. The accounting is accomplished by the ASIC 150. The postal accounting data are stored in non-volatile memories of different technologies.

The system voltage is at the supply input of a second memory 114. This is a non-volatile memory (NVRAM) in a second technology (SHADOW RAM). This second technology preferably includes a RAM and an EEPROM, the latter automatically accepting the data contents given an outage of the system voltage. The NVRAM 114 in the second technology is connected to the corresponding address and data inputs of the ASIC 150 via an internal address and data bus 112, 113.

The ASIC 150 contains at least one hardware accounting unit for calculating the postal data to be stored. Access logic to the ASIC 150 is accommodated in the programmable array logic unit 160. The ASIC 150 is controlled by the logic unit 160. An address and control bus 117, 115 from the motherboard 9 is connected to corresponding pins of the logic unit 160, and the logic unit 160 generates at least one control signal for the ASIC 150 and one control signal 119 for the program memory 128. The processor 120 processes a program that is stored in the memory 128. The processor 120, memory 28, ASIC 150 an logic unit 160 are connected to one another via a module-internal system bus that contains lines 110, 111, 126, 119 for data, address and control signals.

The reset unit 130 is connected via the line 131 to the pin 3 of the processor 120 and is connected to a pin of the ASIC 150. The processor 120 and the ASIC 150 are reset in the reset unit 130 by a reset signal when the supply voltage drops.

The processor 120 of the security module 100 is connected via a module-internal data bus 126 to the memory 128 and to the ASIC 150. The memory 128 serves as a program memory and is supplied with system voltage $U_{s+}$, for example, a 128 Kbyte FLASH memory of the type AM29F01045EC. The ASIC 150 of the postal security module 100—via a module-internal address bus 110—delivers the addresses 0 through 7 to the corresponding address inputs of the memory 128. The processor 120 of the security module 100—via an internal address bus 111—delivers the addresses 8 through 15 to the corresponding address inputs of the FLASH 128. The ASIC 150 of the security module 100 is in communication with the data bus 118, with the address bus 117 and the control bus 115 of the motherboard 9 via the contact group 101 of the interface 8.

As an output voltage on the line 136, the voltage switchover means 180 emits the higher of its input voltages from the voltage monitoring unit 12 and the memory 116. As a result of the possibility of automatically supplying the described circuit with the higher of two voltages dependent on the respective amplitude of the voltages $U_{s+}$and $U_{b+}$, the battery 134 can be changed during normal operation without data loss. The real-time clock 122 and the memory 124 are supplied by an operating voltage via the line 138. This voltage is generated by the voltage monitoring unit 12.

In the quiescent times outside normal operation, the battery of the postage meter machine supplies the real time clock 122 with date and/or time of day registers and/or the static memory (SRAM) 124 that maintains security-relevant data in the aforementioned way. If the voltage of the battery drops below a specific limit during battery operation, then the circuit described in the exemplary embodiment connects the feed point for the clock 122 and the static memory 24 to ground, i.e. the voltage at the clock 122 and at the static memory 124 then lies at 0 volts. This causes the static memory 124 that, for example, contains important cryptographic keys, to be very rapidly erased. At the same time, the registers of the clock 122 are also deleted and the current time of day and the current date are lost. This action prevents a possible tamperer from stopping the clock 122 of the postage meter machine by manipulation of the battery voltage without losing security-relevant data. The tamperer thus is prevented from evading security measures such as, for example, long time watchdogs.

The circuit of the voltage monitoring unit 12, for example, is dimensioned such that any decrease of the battery voltage on the line 136 below the specified threshold of 2.6 V leads to the response of the circuit 12. Simultaneously with the indication of the under-voltage of the battery, the circuit 12 switches into a self-holding condition in which it remains even given a subsequent increase in the voltage. It is also supplies a status signal 164. When the module is turned on the next time, the processor 120 can interrogate the status of the circuit (status signal) and determine that the battery voltage fell below a specific value in the interim either in this way and/or via the interpretation of the contents of the erased memory. The processor 120 can reset (i.e., "arm") the monitoring circuit 12. The monitoring circuit 12 reacts to a control signal on the line 135.

At the same time, the line 136 at the input of the battery monitoring circuit 12 supplies the detection unit 13 with operating or battery voltage. The detection unit 13 can monitor an unplugged sensor or some other sensor and has a self-holding capability that can be reset by the processor 120. The status of the detection unit 13 (self-holding or not triggered) is interrogated by the processor 120 via the line 139, or the detection unit 13 is triggered or reset by the processor 120 via the line 137. A static check for connection is implemented after the resetting. To that end, ground potential is interrogated via a line 192, the terminal (pin) P4 of the interface of the postal security module 100 being at ground and only being capable of being interrogated when the security module 100 is properly plugged-in. With the security module 100 plugged-in, ground potential of the negative pole 104 of the battery 134 of the postal security module PSM 100 is present at the terminal P23 of the interface with the contact group 102 and thus can be interrogated by the detection unit 13 at the terminal P4 of the interface via the line 192.

Lines that form a conductor loop 18 only given a plugged-in security module 100, for example at the motherboard of the meter 1, are connected to the pins 6 and 7 of the processor 120. For dynamically checking the connected status of the postal security module 100 at the motherboard of the meter 1, the processor 120 applies changing signal levels to the pins 6, 7 at very irregular time intervals and these signal levels are looped back via the loop 18.

The processor 120 is equipped with an input/output unit 125 whose terminals pins 8, 9 serve for the output of at least one signal for signaling the status of the security module 100. I/O ports of the input/output unit 125 to which internal signal means of the module are connected, for example colored light-emitting diodes LEDs 107, 108, lie at the pins 8 and 9. These signal the module status through an opening 109 in the meter housing when the security module 100 is plugged onto the motherboard of the meter 1. The security module can assume various statuses over its life cycle. For example, whether the module contains valid cryptographic keys must be detected. It is also important to distinguish whether the module is functioning or is defective. The exact nature and number of module statuses is dependent on the realized functions in the module and on the implementation.

Figure 3:
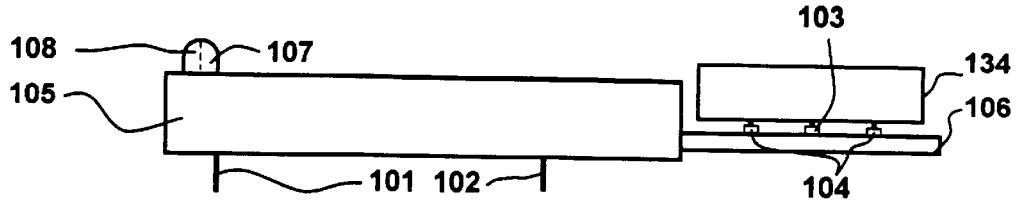
FIG. 3 is a side view of a first version of the inventive security module.

FIG. 3 shows a side view of the mechanical structure of the security module. The security module is fashioned as a multi-chip module, i.e. a number of function units are interconnected on a printed circuit board 106. The security module 100 is potted with a hard casting compound 105, and the battery 134 of the security module 100 is replaceably arranged on the printed circuit board 106 outside the casting compound 105. For example, it is potted with the casting material 105 so that signal elements 107, 108 project from the casting material 106 in a first location, and such that the printed circuit board 106 with the plugged battery 134 projects laterally at a second location. The printed circuit board 106 also has battery contact posts 103 and 104 for the connection of the poles of the battery 134, preferably on the equipping side above the printed circuit board 106. For plugging the postal security module 100 onto the motherboard 9 of the meter 1, the contact groups 101 and 102 are arranged under the printed circuit board 106 (interconnect side) of the security module 100. Via the first contact group 101, the application circuit ASIC 150 is in communication—in a way that is not shown—with the system bus of the control unit 1, and the second contact group 102 serves the purpose of supplying the security module 100 with the system voltage. When the security module 100 is plugged onto the motherboard 9, it is preferably arranged such within the meter housing so that the signal elements 107, 108 are close to an opening 109 or projects there into. The meter housing is thus designed such that the user can see the status display of the security module from the outside. The two signal elements (light-emitting diodes in this embodiment) 107 and 108 are controlled via two output signals of the I/O ports at the pins 8, 9 of the processor 120. Both light-emitting diodes are accommodated in a common component housing (bi-color light-emitting diode), for which reason the dimensions or the diameter of the opening can be relatively small, on the order of magnitude of the signal element. Fundamentally, three different colors can be displayed (red, green, orange), but only two are used (red and green). For distinguishing between statuses, the LEDs are also used in flashing fashion, so that different status groups can be distinguished, these being characterized, for example by the following LED conditions: LED off, LED flashing red, LED red, LED flashing green, LED green.

Figure 4:
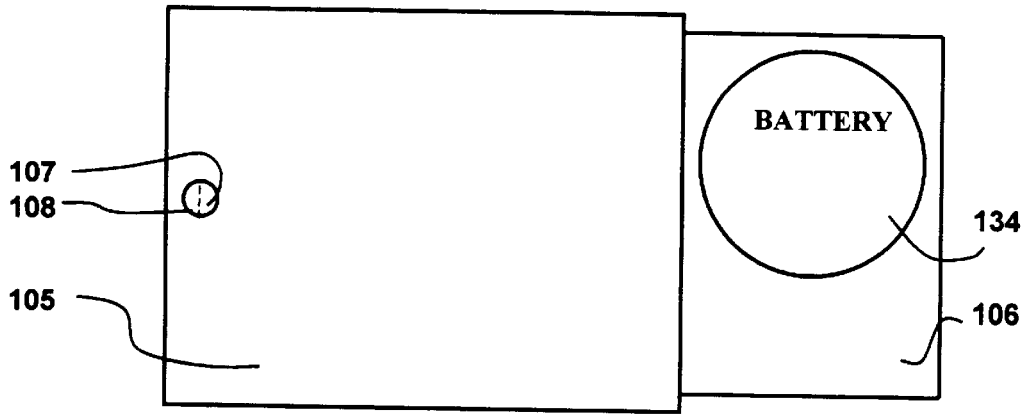
FIG. 4 is a plan view of the first version of the security module.

FIG. 4 shows a plan view of the postal security module in a first version thereof. The casting compound 105 surrounds a first part of the printed circuit board 106 in cuboid fashion, whereas a second part of the printed circuit board 106 remains free of casting compound for the replaceably arranged battery 134. The battery contact posts 103 and 104 are covered here by the battery but can be in turn seen in the side view of FIG. 5*a*.

Figure 5A:
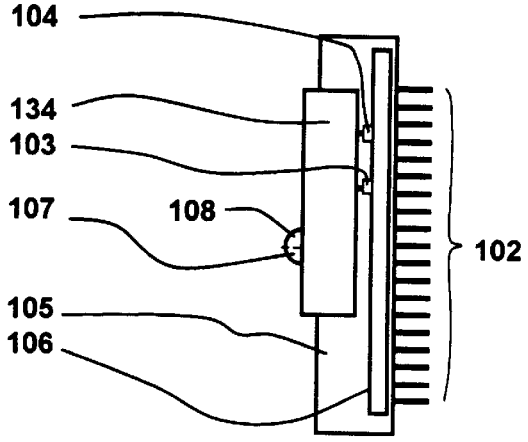
FIG. 5*a* is a view of the inventive security module (first version) from the right.
Figure 5B:
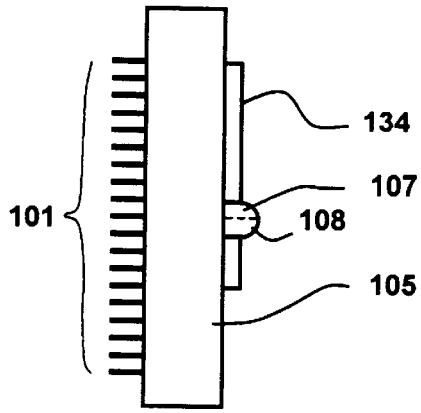
FIG. 5*b* is a view of the inventive security module (first version) from the left.

FIGS. 5*a* and 5*b* show views of the first version of the security module respectively from the right and from the left. The position of the contact groups 101 and 102 under the printed circuit board 106 is more clearly visible from FIGS. 5*a* and 5*b* in conjunction with FIG. 3. The signal elements 107, 108 are preferably connected in the first part of the printed circuit board 106 that is surrounded by the casting material 105 (FIGS. 3, 4 and 5*b*). For energy-saving reasons, the signaling of the module status only ensues when the security module is supplied with system voltage.

Figure 6:
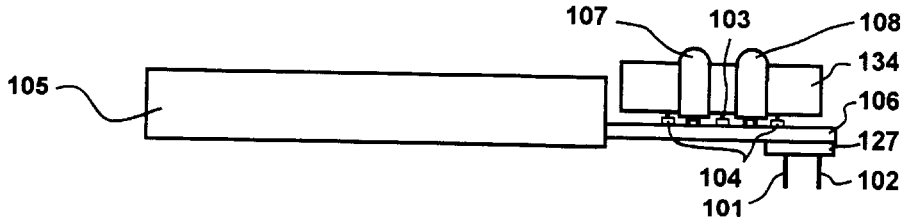
FIG. 6 is a side view of a second version of the inventive security module.

FIG. 6 shows a side view of the mechanical structure of a second version of the security module. The security module is again fashioned as a multi-chip module and is potted with a hard casting compound 105, with the battery 134 of the security module 100 being replaceably arranged on a printed circuit board 106 outside the casting compound 105. For cost reasons, the casting at a first location ensues with a casting material 105 so that the signal elements 107, 108 and the plugged battery 134 are mounted externally from the casting material at a second location on the upper side of the printed circuit board 106. The printed circuit board 106 again has battery contact posts 103 and 104 for the connection of the poles of the battery 134, preferably on the equipping side above the printed circuit board 106. The signal elements 107, 108 are separate components in this version, such as two light-emitting diodes. The two light-emitting diodes 107 and 108 are controlled via two output signals of the I/O port at the pins 8, 9 of the processor 120. For distinguishing between statuses, the LEDs can be controlled in flashing fashion, so that at least five different status groups can be distinguished, these being characterized, for example, by the following LED conditions: LED 107, 108 both off, LED 107 flashing red, LED 107 glowing red, LED 108 flashing green, LED 108 glowing green. The meter housing is likewise designed such that the user can see the status display of the security module from the outside, for example through a viewing window or an opening 109.

For plugging the postal security module 100 onto the motherboard of the meter 1, the contact groups 101 and 102 are arranged under the printed circuit board 106 of the security module 100. Advantageously, a connector 127 contains the contact groups 101 and 102, with the connector 127 being arranged at the interconnect side of the printed circuit board 106.

Figure 7:
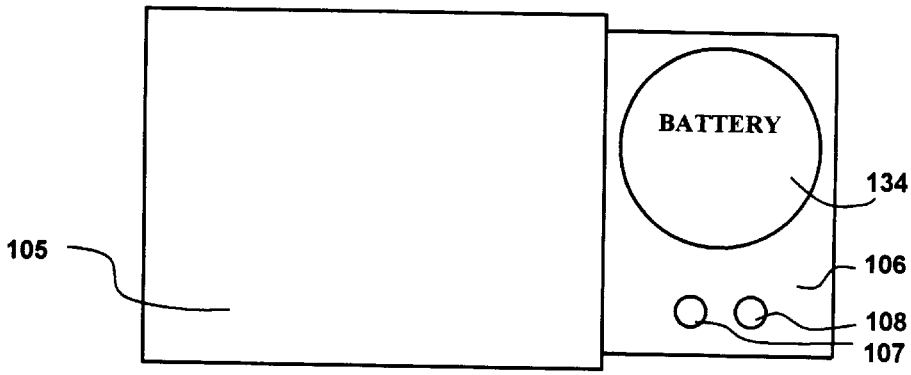
FIG. 7 is a plan view of the second security module version.

FIG. 7 shows a plan view of the postal security module in a second version. The casting compound 105 surrounds the first part of the printed circuit board cuboid-like, whereas the second part of the printed circuit board 106 remains free of casting compound for the two light-emitting diodes 107 and 108, the replaceably arranged battery 137 and for the connector 127 (not visible here). The battery contact posts 103 and 104 are covered by the battery in FIG. 7 but are visible in the side view of FIG. 8*a*, as is the connector 127.

The casting of the first part of the printed circuit board 106 has neither openings nor projections and thus offers fewer points of attack for a tamperer. The casting material 105 is preferably a two-component epoxy resin or polymer or plastic. The casting compound STYCAST®2651-40 FR of the Emerson & Cuming Company with, preferably, CATALYST 9 as a second component, is suitable. In the manufacture of the casting, the two components are mixed and applied on both sides of the printed circuit board 106 in the first part thereof. This can ensue, for example, by dipping into the still-viscous mixture. A protective layer and/or sensor layer can then be applied (not visible from the outside) following a subsequent, outer casting, which firmly bonds with the casting material 105 during the curing of the of the casting material 105. After the final, outer casting, the casting compound hardens to form the solid, opaque casting material 105.

Figure 8A:
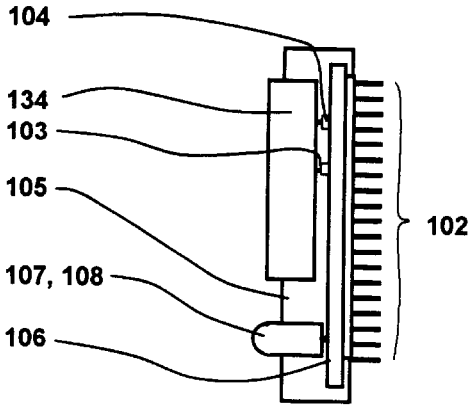
FIG. 8*a* is a view of the security module (second version) from the right.
Figure 8B:
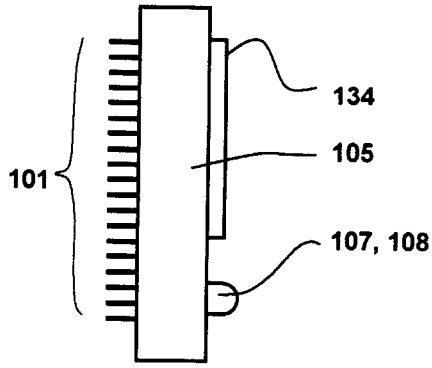
FIG. 8*b* is a view of the security module (second version) from the left.

FIGS. 8*a* and 8*b* respectively show views of the second version of the security module from the right and left. The position of the connector 127 with the contact groups 101 and 102 under the printed circuit board 106 is more clearly visible from FIGS. 8*a* and 8*b* in combination with FIG. 6.

Alternatively, for example, the connector 127—in a way that is not shown—can be attached on the upper side of the second part of the printed circuit board 106.

Figure 9:
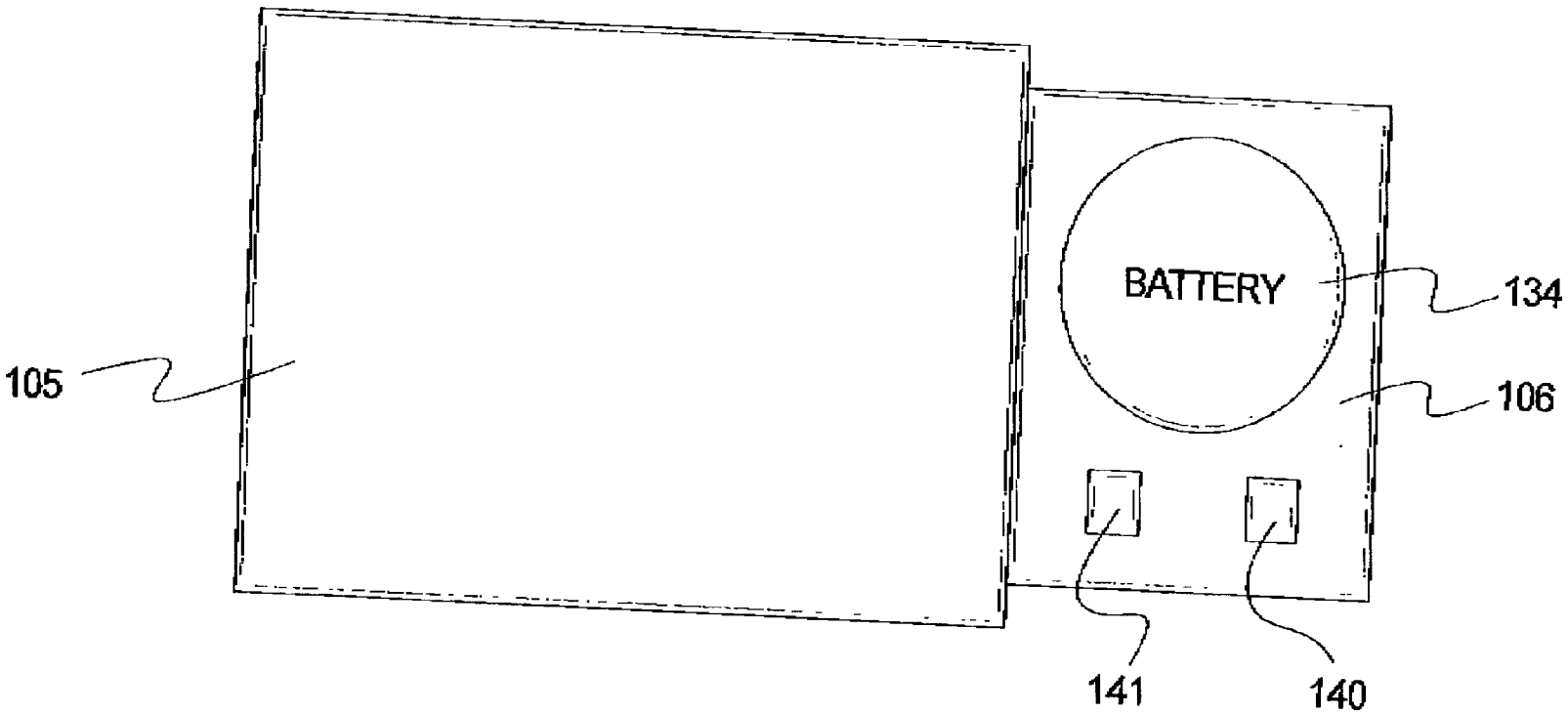
FIG. 9 is a plan view of the security module in an embodiment having LCDs.

As shown in FIG. 9, the signaling elements can be LCDs 140 and 141, which operate in the same manner as the LEDs described above.

Inventively, the postal device is a postage meter machine; however, the security module can also have a different structure that makes it possible for it to be plugged onto the motherboard of, for example, a personal computer that drives a commercially available printer, functioning a as PC franker.

Although modifications and changes may be suggested by those skilled in the art, it is the intention of the inventors to embody within the patent warranted hereon all changes and modifications as reasonably and properly come within the scope of their contribution to the art.

We claim as our invention:

1. A security module comprising:

a plurality of functional units mechanically and electrically mounted on a printed circuit board;

a casting compound surrounding at least a part of said printed circuit board with said functional units thereon, leaving a portion of said printed circuit board free of said casting compound;

battery contact terminals on said portion of said printed circuit board free of said casting compound;

battery releasably connected to said battery contact terminals;

a first contact group on said printed circuit board for communication with an external device and a second contact group on said printed circuit board for supplying said functional units with a system voltage;

a signal element, selected from the group consisting of optical signaling elements and acoustical signaling elements, connected to one of said functional units for signaling a security module status with a signal that is perceptible outside of said casting compound; and said functional units including a unit for identifying when a voltage of said battery falls below a predetermined threshold and thereupon activating said signal element, only when said printed circuit board is supplied with said system voltage.

2. A security module as claimed in claim 1 wherein at least one of said first and second contact groups is surrounded at least one side by said casting compound.

3. A security module as claimed in claim 1 wherein said printed circuit board has a connector carrying said first and second contact groups disposed at one side of said printed circuit board.

4. A security module as claimed in claim 3 wherein said side of said printed circuit board at which said connector is disposed is free of said casting compound.

* * * * *

UNITED STATES PATENT AND TRADEMARK OFFICE

CERTIFICATE OF CORRECTION

PATENT NO. : 6,771,179 B1
DATED : August 3, 2004
INVENTOR(S) : Peter Post et al.

It is certified that error appears in the above-identified patent and that said Letters Patent is hereby corrected as shown below:

Title page,
Insert Item -- [30] Foreign Application Priority Data
March 12, 1999 (DE)……...299 05 219 --

Signed and Sealed this

Twenty-third Day of November, 2004

JON W. DUDAS
*Director of the United States Patent and Trademark Office*